US007090296B2

(12) United States Patent
Massimo

(10) Patent No.: US 7,090,296 B2
(45) Date of Patent: Aug. 15, 2006

(54) ITEM OF SEATING FURNITURE

(75) Inventor: Carrera Massimo, Pesaro (IT)

(73) Assignee: CIAR S.p.A., Pesaro (IT)

( * ) Notice: Subject to any disclaimer, the term of this patent is extended or adjusted under 35 U.S.C. 154(b) by 0 days.

(21) Appl. No.: 10/623,269

(22) Filed: Jul. 19, 2003

(65) Prior Publication Data

US 2004/0017103 A1 Jan. 29, 2004

(30) Foreign Application Priority Data

Jul. 24, 2002 (EP) ..... 02016324

(51) Int. Cl.
*A47C 1/02* (2006.01)

(52) U.S. Cl. ..... 297/319; 297/320; 297/316

(58) Field of Classification Search ..... 297/320, 297/319, 340, 362.14, 362.13, 362.12, 354.1, 297/361.1, 32, 316, 354.12
See application file for complete search history.

(56) References Cited

U.S. PATENT DOCUMENTS 4,072,341 A * 2/1978 Kurz ..... 297/27
4,558,902 A * 12/1985 Meiller ..... 297/284.1
4,636,002 A * 1/1987 Genjiro ..... 297/319
4,640,548 A * 2/1987 Desanta ..... 297/300.3
4,756,575 A * 7/1988 Dicks ..... 297/300.5
4,834,454 A * 5/1989 Dicks ..... 297/317
4,877,291 A * 10/1989 Taylor ..... 297/300.3
4,904,020 A * 2/1990 Hollesen Basse ..... 297/317
5,263,767 A * 11/1993 Asbjornsen et al. ..... 297/320
5,743,591 A * 4/1998 Tame ..... 297/216.1
5,769,493 A * 6/1998 Pejathaya ..... 297/362.12
5,779,312 A * 7/1998 Nagai et al. ..... 297/362.13
5,860,701 A * 1/1999 Jungjohann et al. ..... 297/316
5,868,467 A * 2/1999 Moll ..... 297/317
5,868,468 A * 2/1999 Wang ..... 297/320
5,871,256 A * 2/1999 Kogai ..... 297/300.2
5,884,970 A * 3/1999 Howard ..... 297/362.14
5,979,986 A * 11/1999 Pejathaya ..... 297/362.12
6,030,043 A * 2/2000 Habedank ..... 297/342
6,206,153 B1 * 3/2001 Popjoy ..... 188/300
RE37,928 E * 12/2002 Howard ..... 297/362.14
6,695,404 B1 * 2/2004 Bruske ..... 297/316
6,709,057 B1 * 3/2004 Sander et al. ..... 297/316
2002/0030395 A1 * 3/2002 Switzeny ..... 297/320

* cited by examiner

*Primary Examiner*—Peter M. Cuomo
*Assistant Examiner*—Erika Garrett
(74) *Attorney, Agent, or Firm*—Muramatsu & Associates

(57) ABSTRACT

An item of seating furniture having a seat and a backrest which are supported in an articulated manner on a frame, and having an operating mechanism for adjusting the inclination of the seat and the backrest. The backrest has a catch member and, when the backrest is inclined from a front position into an inclined rear position, the catch member comes into operative contact with the seat as of a specific angle of inclination of the backrest in such a manner that further inclination of the backrest brings about a simultaneous adjustment of the seat. The backrest is adjustable independently of the seat from the front position up to the specific angle of inclination at which the catch member comes into operative contact with the seat.

6 Claims, 2 Drawing Sheets

ITEM OF SEATING FURNITURE

FIELD OF THE INVENTION

The invention relates to an item of seating furniture having a seat and a backrest, which are supported in an articulated manner on a frame, and having an operating mechanism for adjusting the inclination of the seat and the backrest.

BACKGROUND OF THE INVENTION

Items of seating furniture, especially armchairs, that permit motor-aided adjustment of the backrest and the seat are known from practice. By means of a control system, the user can adjust the item of seating furniture continuously between a relatively upright position and a reclined position.

U.S. Pat. No. 4,834,454 discloses an office chair with tiltable seat and back. A lever, swingably mounted to the chair, responds to the specific weight of the user to carry the chair's back forwardly to comfortably support the back of the user without any required adjustment. The seat and the back move simultaneously but in different directions, because the lower arm of the lever pushes the seat upwardly as the chair back is tilted rearwardly.

The operating mechanism usually has an electrical motor which brings about the adjustment of the seat and the backrest by way of a linkage. The user finds it more pleasant when the angle between the seat and the backrest in the reclined position is larger than in the sitting position. In order to bring about this sequence of movement with a single drive motor, relatively complex linkages are provided between the motor, the seat and the backrest in the items of seating furniture known from practice. Those linkages are relatively complex both in terms of manufacture and in terms of assembly. In addition, they require a relatively large amount of installation space, so that such items of seating furniture often appear relatively bulky and unattractive. Although a correspondingly thinner upholstery material could be used, that would lead to an undesirable loss of comfort.

SUMMARY OF THE INVENTION

The object of the invention is therefore to provide an item of seating furniture which is distinguished by a simple operating mechanism.

The item of seating furniture according to the invention has a seat and a backrest which are supported in an articulated manner on a frame. Furthermore, an operating mechanism for adjusting the inclination of the seat and the backrest is provided. The backrest also has a catch member and, when the backrest is inclined from a front position into an inclined rear position, the catch member comes into operative contact with the seat as of a specific angle of inclination of the backrest in such a manner that further inclination of the backrest brings about a simultaneous adjustment of the seat.

In a preferred embodiment, the seat and the backrest have a common pivot axis on the frame. Thus, the backrest is adjustable independently of the seat from the front position up to the specific angle of inclination at which the catch member comes into operative contact with the seat. As a result, the angle between the seat and the backrest can be increased during inclination towards the rear. Only when the catch member comes into operative contact with the seat, and the seat and the backrest are adjusted at the same time, does the angle between the seat and the backrest cease to change.

BRIEF DESCRIPTION OF THE DRAWINGS

Further advantages and forms of the invention will be explained in more detail by means of the description of an embodiment and the drawings. In the drawings.

DETAILED DESCRIPTION OF THE INVENTION

Figure 1:
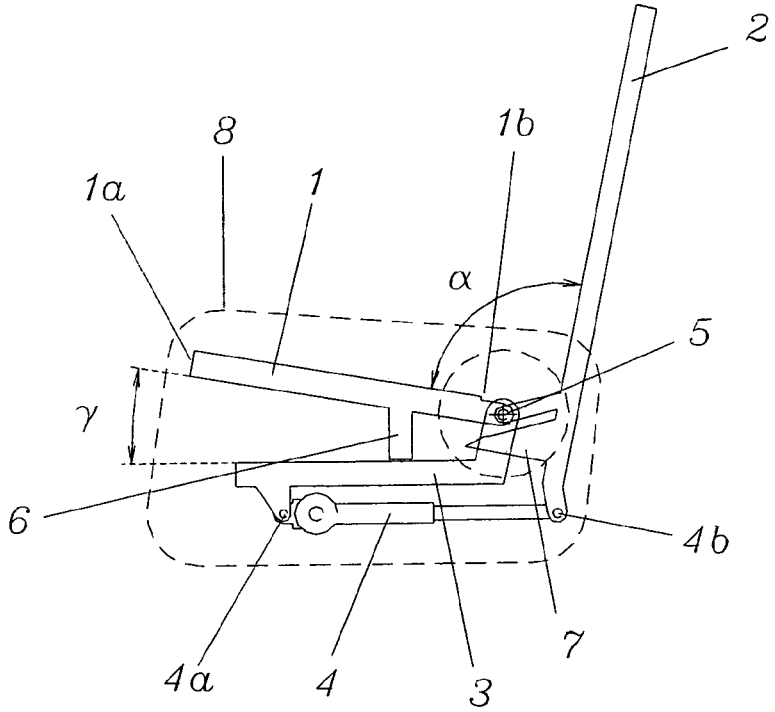
FIG. 1 is a diagrammatic side view of the item of seating furniture in the front position.

The item of seating furniture shown in the drawings consists substantially of a seat 1 and a backrest 2 which are supported in an articulated manner on a frame 3. An operating mechanism 4, which is formed, for example, by a linear drive, is also provided for adjusting the inclination of the seat and the backrest. An armrest 8 is also indicated by a broken line.

The seat 1 has a front region 1*a* and a rear region 1*b* and is supported on the frame 3 in the rear region 1*b* by way of a pivot axis 5. In the position shown in FIG. 1, the seat is supported on the frame by way of a support member 6.

In the transition region between the seat and the backrest, the backrest 2 is likewise supported on the frame by way of the pivot axis 5. However, the support of the seat 1 and the backrest 2 on the pivot axis 5 permits independent adjustment of the seat and the backrest.

The operating mechanism 4, which is formed, for example, by a linear drive, is supported on the frame 3 by its one end 4*a* and is in operative contact with the backrest 2 by its other end. An adjustment of the operating mechanism 4 therefore causes the backrest 2 to pivot about the pivot axis 5, as shown especially in FIG. 2 by various positions of the backrest 2.

Figure 2:
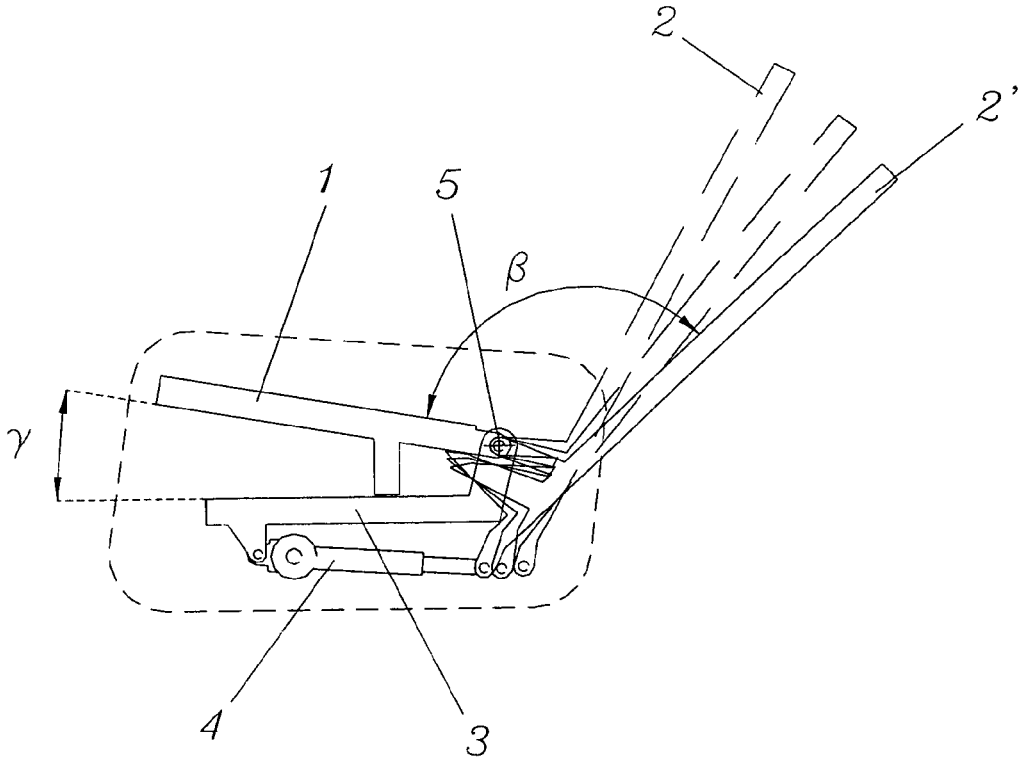
FIG. 2 is a diagrammatic side view of the item of seating furniture in various intermediate positions.
Figure 3:
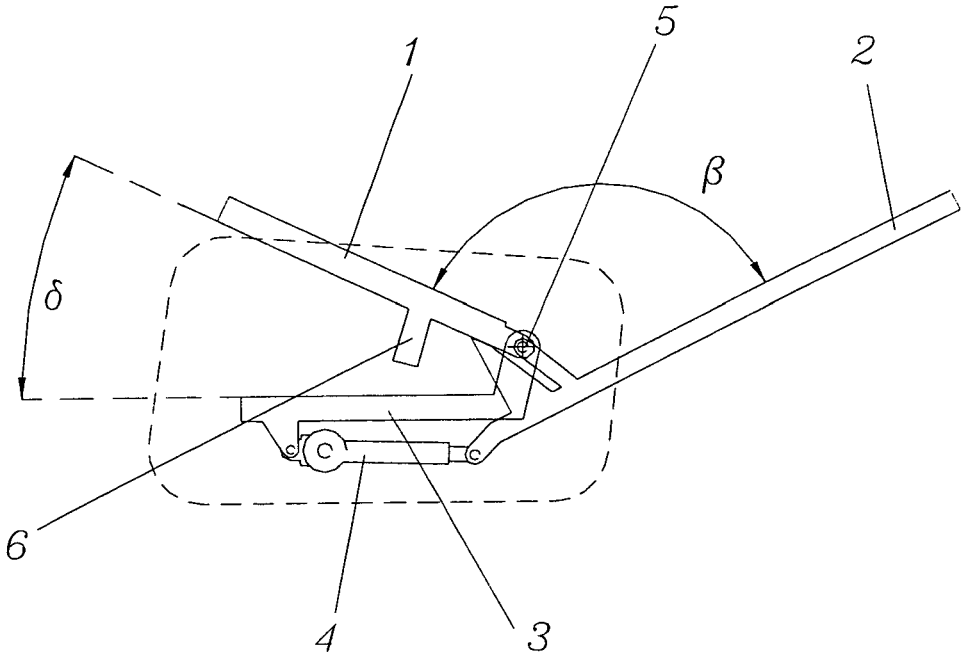
FIG. 3 is a diagrammatic side view of the item of seating furniture in the inclined, rear position.

A catch member 7 is also fitted to the backrest 2 and, when the backrest 2 is inclined from the front position shown in FIG. 1 into an inclined rear position shown in FIG. 3, the catch member 7 comes into operative contact with the seat 1 as of a specific angle of inclination of the backrest in such a manner that further inclination of the backrest brings about simultaneous adjustment of the seat. The specific angle of inclination at which the catch member 7 comes into operative contact with the seat 1 is shown in FIG. 2 by the backrest marked by the reference sign 2'. Further inclination of the backrest towards the rear causes the seat 1 to be entrained, as shown especially in FIG. 3.

By means of a single linear drive of the operating mechanism described above therefore permits adjustment of the backrest 2 relative to the seat 1, the angle $\alpha$ between the seat 1 and 2 changing, for example, from 100° to 130°. Meanwhile, the seat 1 initially remains in its original position. In the embodiment shown, the angle $\gamma$ of the seat 1 relative to the horizontal is, for example, 10°. As soon as the catch member 7 comes into contact with the seat face 1, the angle $\beta$ between the seat face 1 and the backrest 2 no longer changes. Rather, the seat 1 and the backrest 2 continue to be adjusted synchronously, an angle $\gamma$ between the seat 1 and the horizontal of, for example, 25° being set.

The described operating mechanism is distinguished by a very compact and simple structure. Although only one drive motor is necessary, the backrest can be adjusted independently of the seat in the first stage, while common adjustment is permitted in the second stage. Owing to the increase in the angle between the seat and the backrest in the backwardly inclined position, the user is assured an especially pleasant and comfortable reclining position.

Furthermore, the simple and compact structure of the operating mechanism requires only a relatively small installation space, so that aesthetic pieces of furniture can also be produced.

Although the invention is described herein with reference to the preferred embodiments, one skilled in the art will readily appreciate that various modifications and variations may be made without departing from the spirit and the scope of the present invention. Such modifications and variations are considered to be within the purview and scope of the appended claims and their equivalents.

What is claimed is:

1. An item of seating furniture, comprising:

a seat and a backrest both are supported in an articulated manner on a frame, the seat having a front region and a rear region;

an operating mechanism for adjusting inclination of the seat and the backrest; and a catch member formed on the backrest;

wherein when the backrest is inclined from a front position into an inclined rear position, the catch member comes into operative contact with the seat as of a specific angle of inclination of the backrest in such a manner that further inclination of the backrest towards the rear brings about a simultaneous adjustment of the seat; and wherein the seat is supported on the frame at the rear region by a pivot axis and the backrest is adjustable independently of the seat from the front position up to the specific angle of inclination at which the catch member comes into operative contact with the seat.

2. An item of seating furniture as defined in claim 1, wherein the seat and the backrest have the common pivot axis on the frame.

3. An item of seating furniture as defined in claim 1, wherein the backrest is supported on the frame by the pivot axis, the pivot axis being provided in a transition region between the seat and the backrest.

4. An item of seating furniture as defined in claim 1, wherein the operating mechanism is formed by a linear drive which is supported on the frame by one end and is in operative contact with the backrest by another end.

5. An item of seating furniture as defined in claim 1, wherein an angle between the seat and the backrest remains unaltered during the simultaneous adjustment of the seat and the backrest.

6. An item of seating furniture as defined in claim 1, wherein the operating mechanism permits a change in an angle between the seat and the backrest.

* * * * *